US005779056A

United States Patent [19]

Russell et al.

[11] Patent Number: 5,779,056

[45] Date of Patent: Jul. 14, 1998

[54] ELECTROSTATIC DISCHARGE (ESD) PROTECTION SYSTEM FOR SHIELDING A PRINTED CIRCUIT ASSEMBLY DURING MANUFACTURE

[75] Inventors: Robert J. Russell, South Boston; Robert W. Romeri, Quincy, both of Mass.

[73] Assignee: Bull HN Information Systems Inc., Billerica, Mass.

[21] Appl. No.: 702,394

[22] Filed: Aug. 14, 1996

[51] Int. Cl.[6] ..... B65D 85/38

[52] U.S. Cl. ..... 206/709; 206/720

[58] Field of Search ..... 206/701, 706, 206/709, 719, 720, 722; 211/41, 86; 248/95, 97, 122.1, 125.1, 128, 146, 147, 150, 151, 154

[56] References Cited

U.S. PATENT DOCUMENTS

| | | | |
|---|---|---|---|
| 4,160,503 | 7/1979 | Ohlbach | 206/709 |
| 4,354,543 | 10/1982 | Bogner | 248/147 |
| 4,424,900 | 1/1984 | Petcavich | 206/720 |
| 5,405,000 | 4/1995 | Hagedon et al. | 206/720 |

OTHER PUBLICATIONS

"ESD From A to Z, Electrostatic Discharge Control For Electronics", Kolyer et al., 1990, month unknown.

"Static Control in European Union", author unknown, date unknown.

"Precautionary Packaging", Bob Weir, Static Solutions Inc, Jan. 1997.

*Primary Examiner*—Jimmy G. Foster

*Attorney, Agent, or Firm*—Faith F. Driscoll; John S. Solakian

[57] ABSTRACT

An ESD protection system which shields PCAs during the assembly process comprises transportable support means for holding an ESD bag in a predetermined position which is convenient both for the insertion and extraction of a PCA(s) and for observing stored PCA(s), thus ensuring proper handling. The system has first and second attachment means for attaching the ESD bag to the frame and for holding papers associated with the PCA(s) outside the ESD bag and for providing the weight necessary for maintaining a sealing fold in the bag whenever the PCA(s) are enclosed therein. The transportable support means is a frame which is constructed to mate with a rack designed for accommodating a plurality of frames. When so mated, the rack provides the desired level of stability and orderly positioning of a desired number of frames spaced apart such that the ESD bags attached to the frames may be easily observed for correct loading, closure and paperwork processing. When not mated with the rack, the frame and all attachments may be transported with essentially the same convenience as transporting an ESD bag containing a PCA.

25 Claims, 4 Drawing Sheets

ELECTROSTATIC DISCHARGE (ESD) PROTECTION SYSTEM FOR SHIELDING A PRINTED CIRCUIT ASSEMBLY DURING MANUFACTURE

BACKGROUND OF THE INVENTION

1. Field of Use

The present invention relates to the manufacture of printed circuit assemblies (PCAs) and their protection during manufacturing.

2. Prior Art

It is well known that the PCA manufacturing process includes numerous steps to mount components on initially bare printed circuit boards (PCBs) consisting of etched wiring of one or more layers of numerous types of rigid or flexible insulating material. Other steps include conducting one or more tests on complete or partial assemblies, inspecting, repairing and preparing PCAs for shipment. In such processes, PCAs are often stored temporarily when there is to be a time delay between steps.

In addition to the need to assure physical integrity, a particular problem in handling, storing and transporting PCAs is the need to protect certain components that are susceptible to electro-static discharge ESD) damage. Once a point in the process has been reached where a given PCA contains one or more of these ESD-susceptible components, consideration must be given to protecting the PCA whenever it is in an environment which can subject the PCA to potentially damaging voltages. Typically, the workstations at which one or more of the various manufacturing steps are carried out include means of protecting PCAs from ESD damage. Therefore, protecting a PCA from damage when being transported or stored between workstations can be treated as a separate problem from protection at workstations.

Regarding ESD, it is generally accepted by experts in PCA manufacturing processes that specially constructed bags provide the necessary degree of ESD protection. During use, the PCA is placed within the bag and the open end is folded over, to provide an electrostatic shield around the PCA which is the equivalent of a Faraday cage. For the purposes of the present invention, the parameters and methods of achieving adequate shielding are less important than the fact that ESD bags, when properly used, provide an acceptable level of ESD protection in a manufacturing environment.

In the above discussed manufacturing processes, open racks, closed racks and trays are generally used for physically protecting the PCAs. A rack provides numerous slots into which PCA edges may be placed. A tray usually consists of essentially a five-sided box, usually sized for a single PCA and deep enough and otherwise formed to facilitate stacking or holding without placing any pressure on the PCA. Although usually constructed of ESD minimizing material, it will be noted that such open racks provide no ESD protection. Closed racks may offer such protection, but are often difficult to employ during a manufacturing process particularly when a constantly changing variety of PCA sizes is being manufactured.

Trays allow PCAs to be encased in ESD bags before being placed in the trays, potentially providing both physical and ESD protection for a variety of PCA sizes. Trays further provide a means of keeping any related or associated manufacturing paperwork or documents together solely with the particular PCA to which the documents correspond.

Generally, the tray and bag combination has been regarded to offer a high degree of physical and ESD protection. But, it has been noted that there can be significant drawbacks to this latter approach in terms of the expense of trays and the inconvenience of removing and inserting PCAs from and into ESD bags at each manufacturing step.

In addition to the expense and inconvenience, the use of the bag and tray combination can contribute to PCA damage, both ESD and physical. Such problems may not be inherent with the bags and trays, but lie in their improper utilization. A close examination of a multiplicity of trays stored or being handled in a manufacturing area may reveal numerous cases of misuse. For example, physical damage may occur when more than one PCA is contained within a tray originally sized to hold a single PCA. Also, a corner of one tray may inadvertently be pressed against a PCA within another tray as the trays are stacked or otherwise handled. ESD damage may occur as a result of not utilizing ESD bags or leaving a PCA outside of its ESD bag while stored in the tray. The shifting of manufacturing documents within trays may occur which result in the generation of voltages harmful to PCAs not contained in ESD bags. Similar problems may occur from having documents placed within ESD bags containing PCAs.

It may be argued that adequate ESD and physical protection for PCAs is simply a matter of employee discipline in manufacturing areas. But, with constant changes in manufacturing personnel and manufacturing requirements, there is the need to provide such protection without having to expend extensive training and employing elaborate procedures.

Accordingly, it is a primary objective of the present invention to provide a means whereby PCAs may be protected from physical and ESD damage in a manufacturing environment.

It is a further objective of the present invention to provide ESD protection in a manner which promotes proper use.

It is an still further objective of the present invention to provide protection which is less expensive than bag and tray combinations.

It is an even still further objective of the present invention to provide a convenient way of keeping documents associated with a particular PCA in proper order and with the particular PCA while also avoiding possible ESD damage resulting from having such documents coming in contact with the PCA.

SUMMARY OF THE INVENTION

The above objects and advantages of the present invention are achieved in a preferred embodiment of the present invention which comprises a transportable support means for holding an ESD bag in a predetermined position which is convenient both for the insertion and extraction of a PCA(s) and for observing stored PCA(s) and first and second attachment means for attaching the ESD bag to the frame and for holding papers associated with the PCA(s) outside the ESD bag and providing the weight necessary for maintaining a sealing fold in the bag whenever the PCA(s) are enclosed therein.

In the preferred embodiment, the transportable support means is a frame which is constructed to mate with a rack designed for accommodating a plurality of frames. When so mated, the rack provides the desired level of stability that would otherwise have to be incorporated into a base portion of the frame by the addition of more substantial or heavier construction. The rack further provides orderly positioning of the plurality of frames spaced apart such that the ESD bags attached to the frames may be easily observed for correct loading, closure and paperwork. When not mated with the rack, the frame and all attachments may be transported with essentially the same convenience as transporting an ESD bag containing a PCA.

In the preferred embodiment, the frame is constructed to be adjustable so that it is able to accommodate different size ESD bags used for processing different size PCAs. The ESD bag is attached to the frame by the first attachment means, such as removable clips so that the same ESD bag and its PCA contents may be shipped after the final stage of product manufacture without having to remove the PCA from the bag. The second attachment means takes the form of a dual ended clip which is attached to a predetermined location on the lip of one side of the ESD bag. The weight of the clip functions both in holding the ESD bag open to load and unload the PCA and in closing the ESD bag so as to maintain a sealing fold. Additionally, the dual ended clip permits the attachment of associated PCA documents or papers to the PCA without allowing the papers to become a source of ESD damage by contact or close proximity to the PCA. These documents or papers contain information indicative of how the PCA was manufactured, the results of tests, repairs performed, etc. The dual ended clip provides a convenient way for maintaining any particular ordering of such papers or documents.

The above objects and advantages of the present invention will be better understood from the following description when taken in conjunction with the accompanying drawings.

DESCRIPTION OF THE PREFERRED EMBODIMENT

Figure 1A:
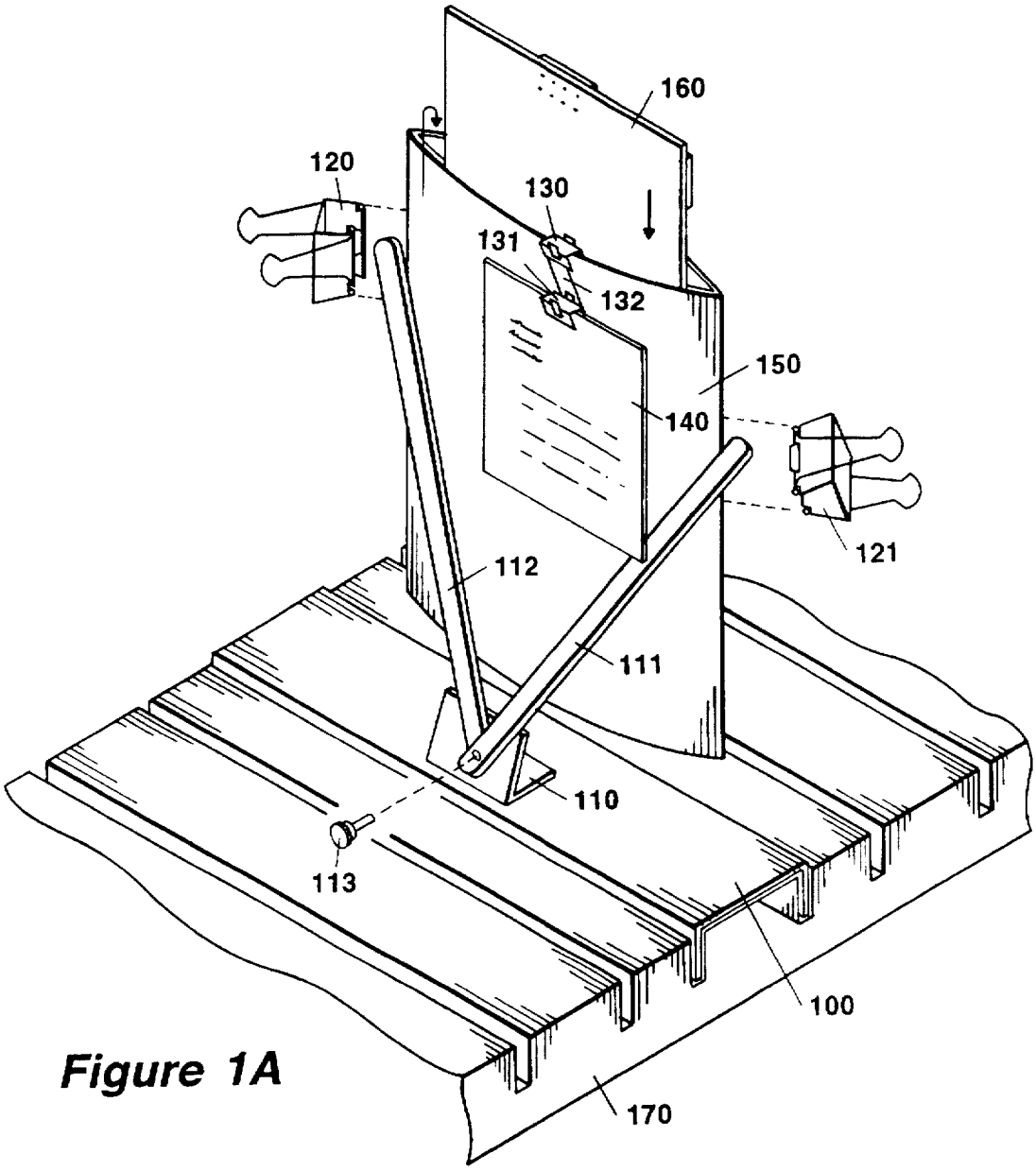
FIGS. 1*a* and 1*b* show the relationships of the principal elements of a preferred embodiment of the present invention.

FIG. 1*a* shows the elements of the ESD system 10 of preferred embodiment of the present invention for protecting a PCA 160 during the manufacture thereof The ESD system 10 includes a V shaped frame comprising a base 100, an angle bracket 110 and a pair of support bars 111 and 112, frame attaching pair of clips 120 and 121, an ESD bag 150 and double clip assembly comprising clips 130 and 131 and connector 132. The "U" shaped base 100 of the frame is selected to have a width dimension which closely fits into any pair of slots contained in a rack 170 while at the same time being easily inserted or removed. For the purpose of the present invention, the pairs of slots can be assumed to be equally spaced. It will be appreciated by those skilled in the art that the spacing between slots and slot sizes can be altered to accommodate different base sizes.

The angle bracket 110 is permanently attached to the base 100. The pair of support bars 111 and 112 attach to angle bracket 110 by means of a thumbscrew 113. The thumbscrew 113 allows adjustment of the angle between the support bars for accommodating various sized ESD bags 150.

The above described frame elements can be constructed from any rigid material (e.g. metal, plastic, etc.) which can be either ESD protective or non-ESD protective material. The ESD bag 150 may be considered conventional in design. An example of one such type of container is described in U.S. Pat. No. 4,424,900.

Clips 120 and 121 are used to hold or attach ESD bag 150 to the support bars 110 and 111 of the frame. As indicated in FIG. 1*a*, bag 150 is held in place by clips 120 and 121 positioned such that several inches or more extend upwards from the top of support bars 111 and 112, which corresponds to the point at which clips 120 and 121 are attached.

Clips 130 and 131 and connector 132 comprise the double-ended clip assembly wherein one end may be attached to the lip of bag 150 as shown and the other end can be used to hold papers or documents 140 uniquely associated with PCA 160 which is shown in FIG. 1*a* in the process of being inserted into ESD bag 150.

Figure 1B:
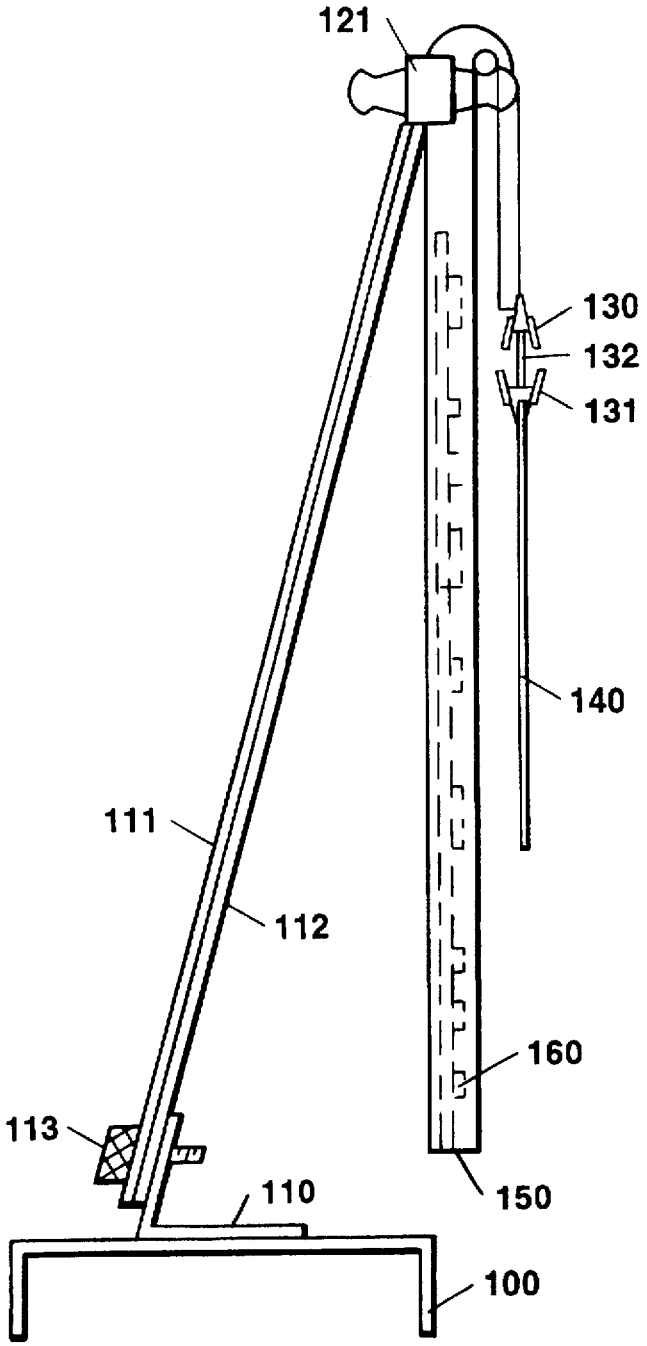

FIG. 1*b* is a side view of FIG. 1*a* showing PCA 160 fully inserted into ESD bag 150. Also, the Figure illustrates the locations of the double-ended clip assembly elements 130, 131 and 132 and papers 140 after having been brought over to the other side of ESD bag 150 as the result of folding the top for sealing. The combined weight of clips 130 and 131 and connector 132 is sufficient to hold a flap formed by folding over the top of ESD bag 150 to a closed position resulting in such sealing.

Figure 1C:
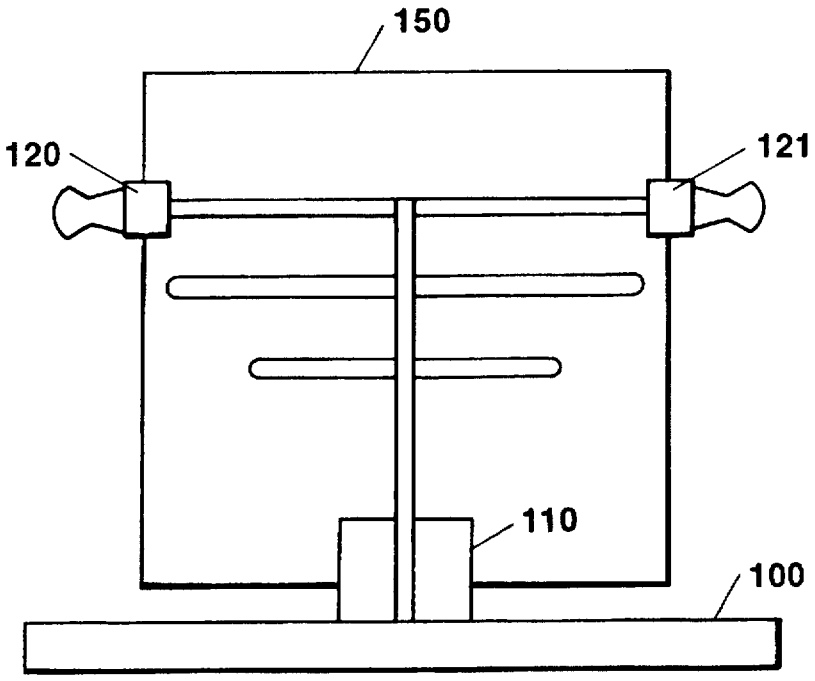
FIG. 1*c* shows an alternate shaped frame which could be used in the preferred embodiment of FIGS. 1*a* and 1*b*.

It will be appreciated that other frame shapes may also be utilized in the ESD protective system 10. For example, as indicated in FIG. 1*c*, a T shaped frame could be used in which clips 120 and 121 are used to attach the sides of ESD bag 150 to the ends of the horizontal member of the T frame structure to hold the bag in place. The vertical member of the T frame structure would be attached to angle bracket 110 in the same manner as the V frame structure as shown in FIG. 1*a*. Also, as indicated in FIG. 1*a*, a number of horizontal members could be used in lieu of a single horizontal member of the T shaped frame for accommodating different size ESD bags (i.e. for different size PCAs).

Figure 2:
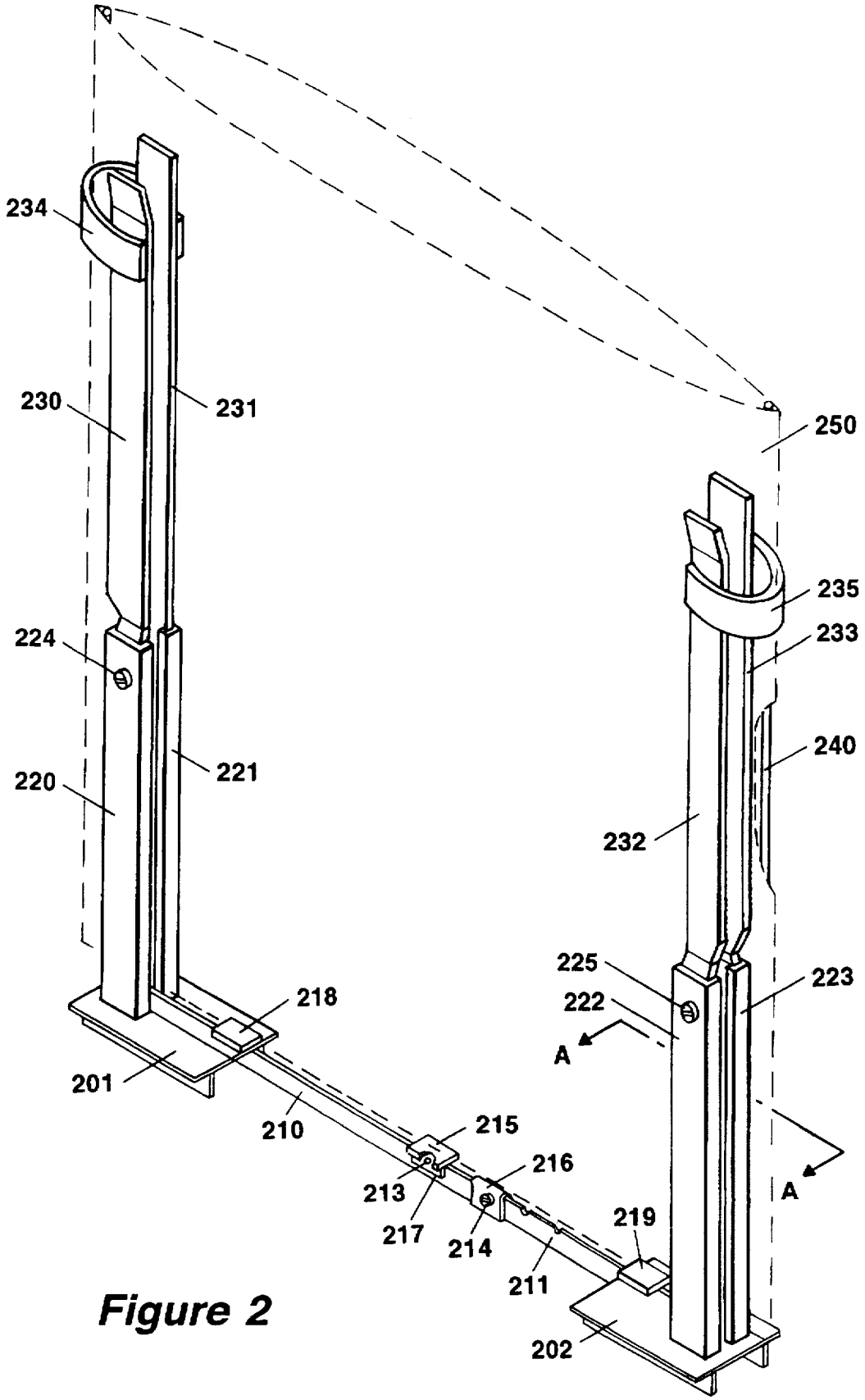
FIG. 2 shows an alternate embodiment of the present invention useful for large PCAs.

FIG. 2 shows an alternate embodiment of a frame used for protecting larger size PCAs. As indicated, the frame includes a base member comprising elements 201 through 219, a pair of vertical members comprising elements 220 through 234 and 222 through 235, vertical oriented positioning element (s) 240 and an ESD bag 250 shown in dotted form. Base elements 201 and 202 are "U" shaped at the bottom to allow insertion into rack 170 of FIG. 1*a* and to provide general support. Horizontal members 210 and 211 of the base member may be adjusted or extended in either direction according to the width and required size of the opening of ESD bag 250. They are loosely held against each other by a pair of like U shaped brackets 213 and 216, the bracket 217 being permanently attached to horizontal member extension 211 and the bracket 216 being permanently attached to horizontal member extension 210. A pair of like setscrews 213 and 214 protrude through their respective U-brackets and cause horizontal member extensions 210 and 211 to be forced against each other so as to hold them in place while also providing a fixed width. Like horizontal supports 215, 218 and 219 provide a smooth support surface for the PCA contained in ESD bag 250.

The vertical members of the frame are comprised of sleeve elements 220 through 223, slider elements 230 through 233 and U shaped brackets 234 and 235. Each of the slider elements 230 through 233 consists of an exposed section, shown and an unexposed section hidden by the corresponding sleeve member. FIG. 2 shows the slider members in their unextended position. The slider elements are formed with a bend between the exposed and unexposed sections such that the gap between the exposed sections of two adjacent slider members (e.g., elements 232 and 233) equals the gap between the two adjacent sleeves into which they are inserted (e.g., elements 222 and 223). The slider elements are further formed to have wider exposed sections to provide a uniform width between the outsides of the sleeves and slider elements. That is, for example, they are formed such that the outside width between sleeves 220 and 222 equals the outside width between the exposed sections of slider elements 230 and 232. Screws 224 and 225 protrude through sleeves 220 and 222, allowing holding their respective slider elements in place once adjusted to a desired height.

The U shaped brackets 234 and 235 maintain a predetermined separation between the slider elements to which they are permanently attached. Furthermore, the loops they form are of sufficient size to allow for ease of insertion of ESD bags. The cutaway section of the bag 250 indicated by dotted lines partially shows a vertical oriented positioning element 240 which has a length which approximates the length between one of the U shaped brackets and its corresponding base element (e.g., between 235 and 202). A like vertical positioning element is used at the other vertical edge of ESD bag 250. The vertical oriented positioning element 240 is made of a flexible material which does not represent an ESD risk (e.g. treated plastic tubing).

The top of slider members 230 and 232 have outward bends to facilitate the insertion of ESD bags while holding a pair of vertical oriented positioning element(s) 240 at the inside edges, as between the thumb and index finger.

Figure 3:
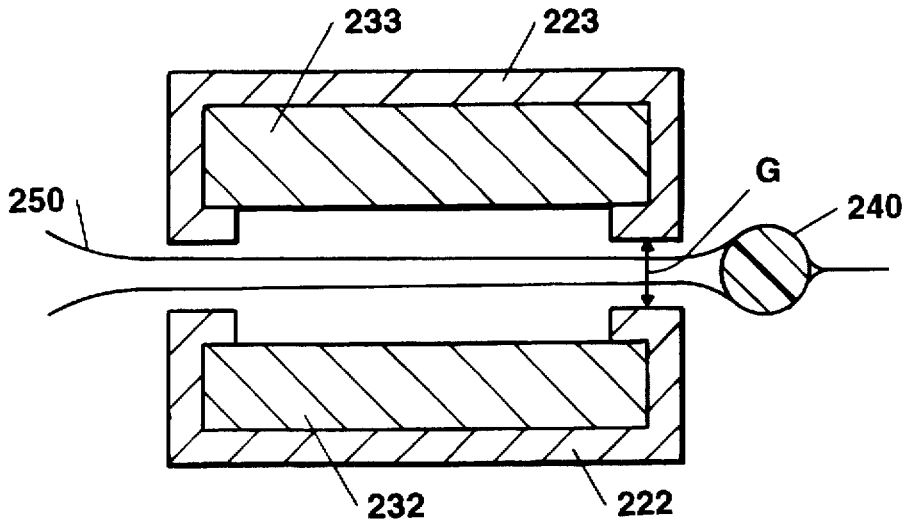
FIG. 3 shows in greater detail, a portion of the frame of FIG. 2.

FIG. 3 shows in greater detail, the construction of the frame vertical member and its relationship to vertical oriented positioning element 240. The figure illustrates these elements after a cross section of sleeve-slider pair 222, 223 and 232, 233 is taken at points A–A' near base element 202 of FIG. 2. As shown, the vertical oriented positioning element 240, within ESD bag 250 is sufficient in width to prevent the bag from being drawn through the gap "G" formed by the sleeves 222 and 223.

DESCRIPTION OF OPERATION

With reference to FIGS. 1*a* through 3, the operation and use of the present invention will now be described. With respect to the preferred embodiment of FIG. 1*a*, the frame support bars 111 and 112 are adjusted by first loosening thumbscrew 113, moving the support bars to the desired degree of separation and tightening the thumbscrew 113. An experienced operator may perform the operation by estimation. Alternatively, the following steps may be employed:

1. Select an ESD bag 150 of sufficient size such that:
   a. PCA 160 may be easily inserted when the width of the bag is slightly reduced.
   b. A flap of approximately three inches may be formed at the top of bag 150 with PCA 160 inserted.
2. Insert a PCA 160 fully into the ESD bag 150.
3. Loosen thumbscrew 113, position the frame support bars 111 and 112 such that they are separated at the top by the present width of bag 150, then tighten thumbscrew 113.
4. Using clips 120 and 121, clip bag 150 to the frame support bars 111 and 112 at points on the side of bag 150 at a location corresponding to the uppermost point of the PCA.
5. Ensure that the bottom of the PCA does not touch base 110. If it does, select longer support bars and begin again at step 1.

Once the proper adjustments have been determined by an operator successful completion of steps 1 through 5, other bags 150 can be clipped to other assemblies of the present invention in desired quantity, using the same adjustments. Since the adjustments have already been determined, there is no need to use a PCA in each case.

The double ended clip assembly comprised of elements 130, 131 and 132 is now clipped to the middle of the lip of each bag 150 as shown in FIG. 1*a*. A series of assemblies of the present invention may be lined up on the rack 170 for subsequent use during the board assembly process When a PCA comes to the point in the assembly process where it is to be stored within an ESD bag during the remaining steps of the manufacturing process (e.g., after soldering), the PCA is inserted into one of the bags already mounted on an assembly of the present invention as shown in FIG. 1*a*. It will be appreciated that the weight of the clip assembly can be used advantageously in keeping the bag open while holding the other lip of the bag with one hand and inserting the PCA into the bag with the other hand.

Once the PCA is enclosed fully within the ESD bag 150, the top of the bag is flipped over to form a flap which is held closed by the weight of the clips. Documents or paperwork indicating details of manufacture of the particular PCA can be clipped to clip 131 at this time. It will be appreciated that a plurality of PCAs may be orderly held in assemblies of the present invention by one or more racks 170. FIG. 1*b* shows the position of the various elements of the present invention subsequent to having performed the above steps.

The operation and use of the alternate embodiment of FIG. 2 will now be described. The following steps may be employed:

1. Loosen screws 213, 214, 224 and 225.
2. Select the length of vertical oriented elements 240 to be equal to the height of the PCA to be used.
3. Insert the PCA into the center of the bag 250.
4. Insert elements 240 into the bag so that they are at the inside edges.
5. Adjust the base horizontal elements of the assembly to be at approximately the correct width (i.e. the bag 250 appears spreadout as shown).
6. Grasping the bag 250 near the closed end and simultaneously holding the outer edges of the PCA with both vertical oriented positioning elements 240 in place within the bag, pick up the bag 250 containing the PCA and vertical elements 240 and slide them into the gap at the top of each pair of sleeves such that the PCA is positioned between the two pairs of sleeves and the outer edges of the bag including the portions of the bag containing the vertical elements 240 as shown in FIG. 3. Again grasp the bag 250 after releasing it allowing it to pass through U shaped brackets 234 and 235 and pull it down to rest on horizontal support elements 215, 218 and 219.
7. Make a final width adjustment, if needed, and tighten screws 213 and 214.
8. Extend slider element pairs 230, 231 and 232, 233 such that the tops of the slider elements are equal with the height of the PCA.
9. Tighten screws 224 and 225.

Once an operator has successfully established the settings, the remaining assemblies of the present invention can be similarly established as required for accommodating the number of PCAs to be processed and then the bags 250 and elements 240 inserted into each frame structure. The assembly of FIG. 2 can be then used in the same way as described above relative to FIG. 1*a*.

It will be appreciated by those skilled in the art that the particular configuration of the frame structure of the present invention may be altered as a function of the type of PCA boards being assembled. Other variations will readily occur to those skilled in the art.

While in accordance with the provisions and statutes there has been illustrated and described the best form of the invention, certain changes may be made without departing from the spirit of the invention as set forth in the appended claims and that in some cases, certain features of the invention may be used to advantage without a corresponding use of other features.

What is claimed is:

1. An electrostatic discharge (ESD) protection system for shielding printed circuit assemblies (PCAs) during their manufacture, the ESD protection system comprising:

(a) an ESD packaging bag sized to house a PCA and having a pair of sides, a sealed bottom and an open end;

(b) a frame support structure including a number of vertical angled support members and a horizontal base member having a pair of ends, the support structure being constructed to have at least one of the number of vertical angled support members positioned mounted to the horizontal base member at a predetermined distance from one of the ends of the horizontal base member, the one vertical angled support member being configured for attaching to the sides of the bag when vertically positioned so as to provide a predetermined confinement area for the PCA inserted into the bag; and, (c) a weighted attachment element attachably mounted to a predetermined point along the open end of the bag, the weighted attachment element being constructed for holding the open end of the bag in an open position for facilitating insertion and removal of the PCA when placed in a first position and for maintaining the open end of the bag in a closed position when placed in a second position by folding over the open end of the bag to maintain ESD protection.

2. The system of claim 1 wherein the number of vertical angled support members includes a pair of like vertical angled members, the frame structure being constructed to have each of the pair of vertical angled members mounted at a predetermined distance from one of the ends of the horizontal base member, each vertical angled member including a retaining element for receiving and attaching to each of the pair of sides of the bag when vertically positioned so as to provide a predetermined confinement area for the PCA inserted into the bag.

3. The system of claim 1 wherein the number of vertical angled support members includes a pair of like members configured to form a V like structure mounted to the horizontal base member, each member being attachable to a different side of the ESD bag.

4. The system of claim 1 wherein the system further includes a rack having a plurality of slots used for holding a corresponding number of frame support structures, the horizontal base member of each frame support structure having a bottom which is contoured to closely conform to a pair of adjacent slots of the rack.

5. The system of claim 4 wherein the bottom of the horizontal base member of each frame support structure is contoured to have an inverted U shape.

6. The system of claim 1 wherein the horizontal and vertical members are constructed to be adjustable in width and height respectively to accommodate use with different size PCAs and ESD bags.

7. The system of claim 1 wherein the weighted attachment element includes a fastener element at one end for attaching documents associated with each PCA being inserted into the ESD bag.

8. The system of claim 2 wherein the retaining elements are each constructed from two vertical pieces attached to each other to form a guide having a predetermined width so as to enable the sides of the bag to be inserted therebetween and have dowel like elements vertically positioned within the bag to complete the attachment of the sides of the vertical mounted bag in a secure manner.

9. The system of claim 8 wherein the dowel like elements are constructed from flexible material.

10. The system of claim 9 wherein the flexible material is non-static generating tubing.

11. The system of claim 8 wherein the vertical pieces are constructed to allow the bag to be easily folded at a number of points which are less than the full height of the vertical pieces.

12. The system of claim 1 wherein the support structure is constructed from other than ESD protective material.

13. The system of claim 1 wherein the support structure is constructed from ESD protective material.

14. The system of claim 2 wherein the system further includes a PCA housed in the ESD packaging bag and wherein the vertical angled members have a height dimension which is at least equal to the smaller dimension of the PCA.

15. The system of claim 6 wherein the support member structure is constructed from other than ESD protective material.

16. The system of claim 6 wherein the support member structure is constructed from ESD protective material.

17. An electrostatic discharge (ESD) protection system for shielding printed circuit assemblies (PCAs) during their manufacture, the ESD protection system comprising:

(a) an ESD packaging bag sized to house a PCA and having a pair of sides, a sealed bottom and an open end;

(b) a frame support structure including a T shaped vertically positioned member, and a horizontal base member having a pair of ends, the T shaped member being positioned at a central point along the horizontal base member, the T shaped member being attachable to the sides of the ESD bag; and, (c) a weighted attachment element attachably mounted to a predetermined point along the open end of the bag, the weighted attachment element being constructed for holding the open end of the bag in an open position for facilitating insertion and removal of the PCA when placed in a first position and for retaining the open end of the bag in a closed position when placed in a second position by folding over open end of the bag to maintain ESD protection.

18. The system of claim 17 wherein the T shaped member includes an additional number of horizontal members located at different positions along a vertical portion of the T shaped vertically positioned member for attaching different size ESD bags with different size PCAs.

19. The system of claim 18 wherein the bottom of the horizontal member is contoured to have an inverted U shape.

20. An electrostatic discharge (ESD) protective system for shielding a printed circuit assembly (PCA) during manufacture, the ESD system comprising:

(a) an ESD packaging bag sized to house a PCA and having a pair of sides, a sealed bottom and an open end;

(b) a horizontal base member;

(c) a support structure including a number of vertical angled members mounted to the horizontal base member and configured for enabling attachment of predetermined portions of the members to the sides of the bag when vertically positioned and for providing a predetermined confinement area for securely supporting the PCA when inserted into the ESD bag, and, (d) a weighted attachment element attachably mounted to a predetermined point along the open end of the bag, the weighted attachment element being constructed for holding the open end of the bag in an open position for facilitating insertion and removal of the PCA when placed in a first position and for retaining the open end of the bag in a closed position when the weighted attachment element is placed in a second position by folding over open end of the bag to provide ESD protection.

21. The system of claim 20 wherein the weighted attachment element has a pair of ends, each end having an attachment element, one end of the pair being attachable to the predetermined point along the open end of the bag and the other end being attachable to documents associated with PCA inserted into the ESD bag.

22. An electrostatic discharge (ESD) protective system for shielding a printed circuit assembly (PCA) during manufacture, the ESD system comprising:

(a) an ESD packaging bag sized to house a PCA and having a pair of sides, a sealed bottom and an open end;

(b) a horizontal base member;

(c) a support structure attached to the horizontal base member, the support structure including a number of members configured for enabling attachment of predetermined ones of the members to the sides of the bag when vertically positioned and for providing a predetermined confinement area for securely supporting the PCA when inserted into the ESD bag, and, (d) a weighted attachment element attachably mounted to a predetermined point along the open end of the bag, the weighted attachment element being constructed for holding the open end of the bag in an open position for facilitating insertion and removal of the PCA when placed in a first position and for retaining the open end of the bag in a closed position when placed in a second position by folding over open end of the bag to maintain ESD protection, the weighted attachment element having a pair of ends, each end having an attachment element, one end of the pair being attachable to the predetermined point along the open end of the bag and the other end being attachable to documents associated with PCA inserted into the ESD bag.

23. The system of claim 22 wherein each attachment element includes a clip-on device.

24. An electrostatic discharge (ESD) protection system for shielding printed circuit assemblies (PCAs) during their manufacture, the ESD protection system comprising:

(a) an ESD packaging bag sized to house a PCA and having a pair of sides, a sealed bottom and an open end;

(b) a frame support structure including a pair of vertical angled support members, each support member having a pair of ends and a horizontal base member having a substantially flat top surface, the support structure being constructed to have each of the pair of vertical angled support members mounted generally perpendicular to the top surface of the horizontal base member, the pair of vertical angled support members being configured relative to each other for attaching to the sides of the bag when vertically positioned so as to provide a predetermined confinement area for the PCA inserted into the bag; and, (c) a weighted attachment element attachably mounted to a predetermined point along the open end of the bag, the weighted attachment element being constructed for holding the open end of the bag in an open position for facilitating insertion and removal of the PCA when placed in a first position and for retaining the open end of the bag in a closed position when placed in a second position by folding over the open end of the bag to maintain ESD protection.

25. An electrostatic discharge (ESD) protection system for shielding printed circuit assemblies (PCAs) during their manufacture, the ESD protection system comprising:

(a) an ESD packaging bag sized to house a PCA and having a pair of sides, a sealed bottom and an open end;

(b) a frame support structure including a horizontal base member having a substantially flat top surface and pair of vertical angled support members, each having a pair of ends, the pair of vertical angled support members being configured to form a V like structure having those ends joined in close proximity to each other, mounted to the top surface of the horizontal base member, the support members being configured to be attachable to a different side of the ESD bag when vertically positioned so as to provide a predetermined confinement area for the PCA inserted into the bag; and, (c) a weighted attachment element attachably mounted to a predetermined point along the open end of the bag, the weighted attachment element being constructed for holding the open end of the bag in an open position for facilitating insertion and removal of the PCA when placed in a first position and for maintaining the open end of the bag in a closed position when placed in a second position by folding over the open end of the bag to maintain ESD protection.

* * * * *